US007501920B2

(12) United States Patent
Yuba et al.

(10) Patent No.: US 7,501,920 B2
(45) Date of Patent: Mar. 10, 2009

(54) SWITCH DEVICE

(75) Inventors: Takashi Yuba, Shinagawa (JP); Hideki Iwata, Shinagawa (JP); Yuriko Segawa, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 341 days.

(21) Appl. No.: 11/296,341

(22) Filed: Dec. 8, 2005

(65) Prior Publication Data

US 2006/0131150 A1 Jun. 22, 2006

(30) Foreign Application Priority Data

Dec. 21, 2004 (JP) ..... 2004-370281

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS 5,872,496 A * 2/1999 Asada et al. ..... 335/78
6,057,520 A * 5/2000 Goodwin-Johansson .... 200/181
6,124,650 A * 9/2000 Bishop et al. ..... 310/40 MM
6,153,839 A * 11/2000 Zavracky et al. ..... 200/181
6,307,169 B1 * 10/2001 Sun et al. ..... 200/181
6,384,353 B1 * 5/2002 Huang et al. ..... 200/181
6,806,545 B2 * 10/2004 Shim ..... 257/420
7,053,736 B2 * 5/2006 Nelson ..... 335/70
7,084,724 B2 * 8/2006 Cetiner et al. ..... 333/262
7,202,763 B2 * 4/2007 Six ..... 335/78

FOREIGN PATENT DOCUMENTS

| | | |
|---|---|---|
| JP | 2-100224 | 4/1990 |
| JP | 2532487 | 1/1997 |
| JP | 11-111146 | 4/1999 |
| JP | 2000-164104 | 6/2000 |
| JP | 2001-291463 | 10/2001 |

* cited by examiner

*Primary Examiner*—Elvin G Enad
*Assistant Examiner*—Bernard Rojas
(74) *Attorney, Agent, or Firm*—Staas & Halsey LLP

(57) ABSTRACT

A switch device includes: a movable spring that has one end as a fixed end, and the other end as a free end; a substrate that is disposed below the movable spring; a first contact point that is disposed at a predetermined location between the fixed end and the free end of the movable spring; a protrusion that is formed on the substrate and is located to face the free end of the movable spring; and a second contact point that is provided on the substrate and is located to face the first contact point. This switch device is put into an ON state when the free end of the movable spring is brought into contact with the protrusion and the first contact point is brought into contact with the second contact point.

8 Claims, 18 Drawing Sheets

SWITCH DEVICE

BACKGROUND OF THE INVENTION

1. Field of the Invention

The present invention relates to a switch device that performs switching on and off of electric signals by bringing contact points into contact with each other and separating the contact points from each other.

2. Description of the Related Art

A microrelay that is a switch device is manufactured by semiconductor fine processing technology, and switches various electric signals such as radio-frequency signals. Such a microrelay has a number of advantageous features such as size that is smaller than a conventional relay, and therefore, has attracted public attention in recent years. Examples of such microrelays are disclosed in Japanese Unexamined Patent Publication Nos. 2001-291463, 2000-164104, 11-111146, and 2-100224, and Japanese Utility Model Gazette No. 2532487.

FIG. 1 is a side view of a first conventional microrelay. In the microrelay illustrated in FIG. 1, a movable spring 510 is disposed above a substrate 520. The movable spring 510 has one end fixed by a fixing member 530, and the other end as a free end. A contact point 512 that serves as a movable contact point is provided at the free end. Another contact point 522 that serves as a fixed contact point is provided on the substrate 520, and is located to face the contact point 512.

When a voltage is applied between the contact point 512 and the contact point 522, the contact point 512 moves toward the contact point 522 in synchronization with the movement of the movable spring 510 by virtue of electrostatic attraction, as shown in FIG. 2. The contact point 512 finally comes into contact with the contact point 522. Thus, the microrelay is put into an ON state.

FIG. 3 is a side view of a second conventional microrelay. In the microrelay illustrated in FIG. 3, a movable spring 510 is disposed above a substrate 520. The movable spring 510 has both ends fixed by fixing members 530. A contact point 512 that serves as a movable contact point is provided in the approximate center of the surface of the movable spring 510. On the substrate 520, another contact point 522 that serves as a fixed contact point is provided to face the contact point 512.

When a voltage is applied between the contact point 512 and the contact point 522, the contact point 512 moves toward the contact point 522 in synchronization with the movement of the movable spring 510 by virtue of electrostatic attraction, as shown in FIG. 4. The contact point 512 finally comes into contact with the contact point 522. Thus, the microrelay is put into an ON state.

In the above described first conventional microrelay, however, the entire surface of the contact point 512 cannot be brought into contact with the entire surface of the contact point 522. Because of this, it is difficult to stabilize the value of contact resistance, and only particular spots in the contact points are abraded. As a result, the service lives of the contact points become short.

In the second conventional microrelay, the surface of the contact point 512 can be brought into contact with the surface of the contact point 522, as shown in FIG. 4. However, the second conventional microrelay has more drawbacks than the first microrelay, in terms of the flexibility of the movable spring 510.

More specifically, the flexibility $\sigma$ of the movable contact point is expressed as $\sigma=PL^3/3EI$ (Equation 1), where L represents the length of the movable spring 510, E represents the Young's modulus, I represents the second moment of area, and P represents the load applied to the movable contact point in the first conventional microrelay. On the other hand, when the load P is applied to the movable contact point in the first conventional microrelay, the flexibility $\sigma$ of the movable contact point is expressed as $\sigma=PL^3/192EI$ (Equation 2).

The distance (the contact point distance) between the movable contact point and the fixed contact point in an OFF state is determined by the required withstand voltage between the contact points, the isolation characteristics, and the likes. In a case where the force for driving the movable spring 510 (i.e., the load P in Equations 1 and 2) is constant, so as to obtain the same contact point distances in the first and second conventional microrelays, the movable spring 510 of the second conventional microrelay needs to be four times as long as the movable spring 510 of the first conventional microrelay. Therefore, the second conventional microrelay cannot be made smaller in size.

In a case where the length of the movable spring 510 is constant, so as to obtain the same contact point distances in the first and second conventional microrelays, the second conventional microrelay requires a driving force 64 times as great as the driving force required in the first conventional microrelay. Since the electrostatic attraction between the contact point 512 and the contact point 522 is proportional to the square of the voltage to be applied between the contact point 512 and the contact point 522, the voltage to be applied between the contact point 512 and the contact point 522 in the second conventional microrelay needs to be eight times as high as the voltage to be applied between the contact point 512 and the contact point 522 in the first conventional microrelay. Therefore, there has been an increasing demand for a method of reducing a required driving voltage and stabilizing the contact resistance, without an increase in size.

SUMMARY OF THE INVENTION

It is therefore an object of the present invention to provide a switch device in which the above disadvantage is eliminated.

A more specific object of the present invention is to provide a switch device that can perform a more precise switching operation.

According to an aspect of the present invention, there is provided a switch device including: a movable spring that has one end as a fixed end, and the other end as a free end; a substrate that is disposed below the movable spring; a first contact point that is disposed at a predetermined location between the fixed end and the free end of the movable spring; a protrusion that is formed on the substrate and is located to face the free end of the movable spring; and a second contact point that is provided on the substrate and is located to face the first contact point, the switch device being put into an ON state when the free end of the movable spring is brought into contact with the protrusion and the first contact point is brought into contact with the second contact point.

With the above structure, the movable spring is bent so that the fee end is brought into contact with the protrusion. It is thus possible to prevent portions other than the first and second contact points from being brought into contact with the movable spring and to achieve area-contact between the first and second contact points. This stabilizes the contact resistance. In addition, the movable spring with a free end has an improved degree of movement as compared to another movable spring having the two stationary contacts. Thus, a large voltage is needed to make contact with the first and second contacts.

According to another aspect of the present invention, there is provided a switch device including: a movable spring that has one end as a fixed end, and the other end as a free end; a substrate that is disposed below the movable spring; a first contact point that is disposed at a predetermined location between the fixed end and the free end of the movable spring; a protrusion that is formed at the free end of the movable spring; and a second contact point that is provided on the substrate and is located to face the first contact point, the switch device is put into an ON state when the protrusion is brought into contact with the substrate and the first contact point is brought into contact with the second contact point.

According to a further aspect of the present invention, there is provided a switch device including: a movable spring that has an end as a fixed end; a substrate that is disposed below the movable spring; a first contact point that is provided to the movable spring except the region of the fixed end; a second contact point that is provided to the movable spring except the region of the fixed end; a third contact point that is provided onto the substrate and is located to face the first contact point; and a fourth contact point that is provided onto the substrate and is located to face the second contact point, the switch device being put into an ON state when the first contact point is brought into contact with the third contact point and the second contact point is brought into contact with the fourth contact point, the switch device being put into an OFF state when the first contact point is separated from the third contact point and the second contact point is separated from the fourth contact point.

According to a still further aspect of the present invention, there is provided a switch device including: a movable spring; a substrate that is disposed below the movable spring; a first contact point that is provided to the movable spring; a coil that is disposed on the substrate and is located to face a magnetic member; and a second contact point that is provided onto the substrate and is located to face the first contact point, the switch device being put into an ON state when the movable spring is attracted toward the substrate by voltage application to the coil and the first contact point is brought into contact with the second contact point by voltage application between the first contact point and the second contact point.

According to another aspect of the present invention, there is provided a switch device including: a movable spring; a substrate that is disposed below the movable spring; a coil that is provided to the movable spring; a first contact point that is provided to the movable spring; and a second contact point that is provided onto the substrate and is located to face the first contact point, the switch device being put into an ON state when the movable spring is attracted toward the substrate by voltage application to the coil and the first contact point is brought into contact with the second contact point by voltage application between the first contact point and the second contact point.

The switch device of the present invention can perform a precise switching operation, having a higher degree of freedom in movement of the movable spring.

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENTS

The following is a description of switch devices as embodiments of the present invention, with reference to the accompanying drawings.

Figure 1:
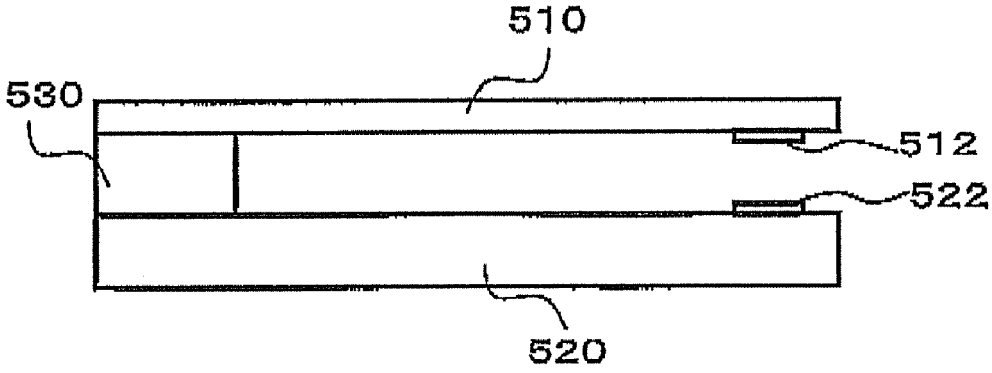
Fig. 1 PRIOR ART
FIG. 1 is a side view of a first conventional microrelay in an OFF state.
Figure 2:
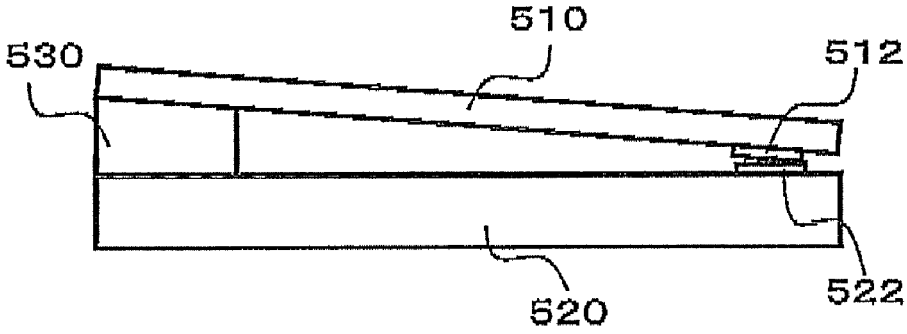
Fig. 2 PRIOR ART
FIG. 2 is a side view of the first conventional microrelay in an ON state.
Figure 3:
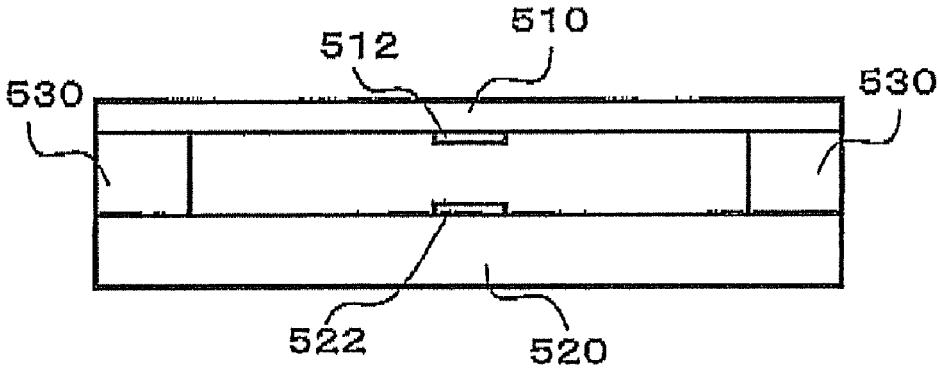
Fig. 3 PRIOR ART
FIG. 3 is a side view of a second conventional microrelay in an OFF state.
Figure 4:
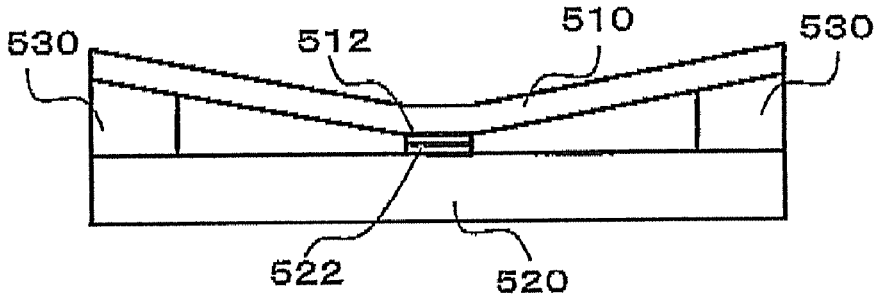
Fig. 4 PRIOR ART
FIG. 4 is a side view of the second conventional microrelay in an ON state.
Figure 5:
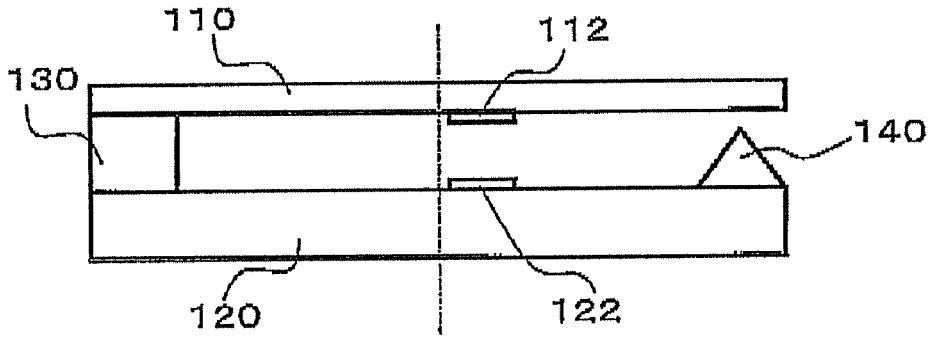
FIG. 5 is a side view of a microrelay as a first switch device that is in an OFF state.

Referring first to FIG. 5, a first switch device is described. FIG. 5 is a side view of a microrelay as the first switch device. In the microrelay illustrated in FIG. 5, a movable spring 110 that is made of silicon or the like is placed above a substrate 120 that is made of silicon, Pyrex (trade name), or the like. This movable spring 110 has one end fixed by a fixing member 130 to form a fixed end, with the other end being a free end. A protrusion 140 is formed on the substrate 140. The protrusion 140 is located to vertically face the free end of the movable spring 110. The protrusion 140 is shorter than the fixing member 130. A contact point 112 that serves as a movable contact point is provided at a location slightly closer to the free end of the movable spring 110. Another contact point 122 that is a fixed contact point is provided at such a location on the substrate 120 that the contact point 122 vertically faces the contact point 112. In the situation illustrated in FIG. 5, the contact point 112 and the contact point 122 are not in contact with each other, so that the microrelay is in an OFF state.

Figure 6:
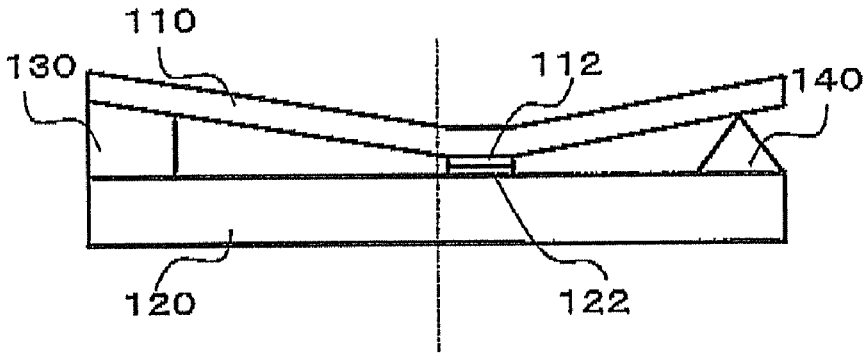
FIG. 6 is a side view of the microrelay as a first switch device that is in an ON state.

When a voltage is applied between the contact point 112 and the contact point 122, the movable spring 110 except the fixed end moves downward until the free end of the movable spring 110 comes into contact with the top portion of the protrusion 140 and the surface of the contact point 112 comes into contact with the surface of the contact point 122, as shown in FIG. 6, by virtue of the electrostatic attraction between the contact point 112 and the contact point 122. Thus, the microrelay is put into an ON state. Since the contact point 112 is located slightly closer to the free end than to the fixed end of the movable spring 110 and the protrusion 140 is shorter than the fixed member 130, the contact point 112 is the maximum displacement point of the movable spring 110. When the voltage between the contact point 112 and the contact point 122 is cut off, the contact point 112 moves away from the contact point 122 by virtue of the restoring force of the movable spring 110, and the microrelay is put into an OFF state.

As described above, in the microrelay that is the first switch device, the free end of the movable spring 110 is brought into contact with the protrusion 140 as the movable spring 110 bends down. Accordingly, short-circuiting between the movable spring 110 and the substrate 120 except the contact point 112 and the contact point 122 is prevented, and the contact resistance can be stabilized as the surface of the contact point 112 of the movable spring 110 is brought into contact with the surface of the contact point 122 of the substrate 120. Also, the service lives of the contact point 112 and the contact point 122 can be prolonged. Furthermore, since one end of the movable spring 110 is a free end, the degree of freedom in movement of the movable spring 110 is higher than in a case where both ends of the movable spring are fixed ends, and there is no need to increase the voltage to bring the contact point 112 into contact with the contact point 122.

Further, compared with a microrelay that has a movable spring having both ends fixed, the distance (the contact point distance) between the movable contact point and the fixed contact point of the microrelay as the first switch device in an OFF state is the same. If the driving force for moving the movable spring is constant, the movable spring 110 of the microrelay as the first switch device can be made ¼ of the length of the movable spring having both ends fixed. Thus, the microrelay as the first switch device can be made smaller in size. If the length of the movable spring 110 of the microrelay as the first switch device is the same as the length of the movable spring having both ends fixed, the voltage to be applied between the contact point 112 and the contact point 122 can be made ⅛ of the voltage to be applied in the case of the movable spring having both ends fixed. Thus, the driving voltage can be reduced.

In the microrelay as the first switch device, the movable spring 110 is moved by the electrostatic attraction produced as a voltage is applied between the contact point 112 and the contact point 122. However, it is also possible to move the movable spring 110 by the electromagnetic attraction produced by applying a voltage to coils that are provided on either one of the movable spring 110 and the substrate 120. In such a case, a higher degree of freedom is allowed for movement of the movable spring 110, and the current flowing through the coils for bringing the contact point 112 into contact with the contact point 122 can be made smaller or the number of coils can be made smaller, compared with a case where the movable spring has both ends fixed.

Figure 7:
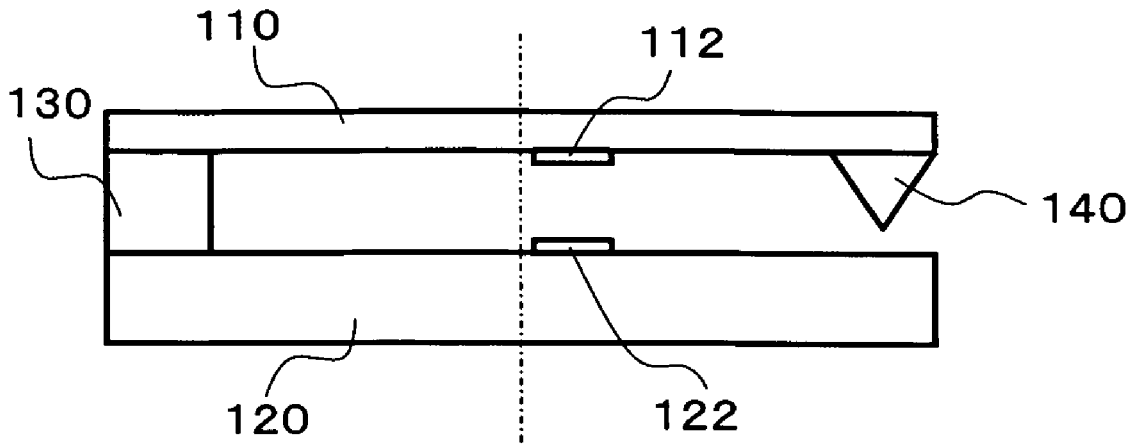
FIG. 7 is a side view of a first modification of the microrelay as a first switch device that is in an OFF state.
Figure 8:
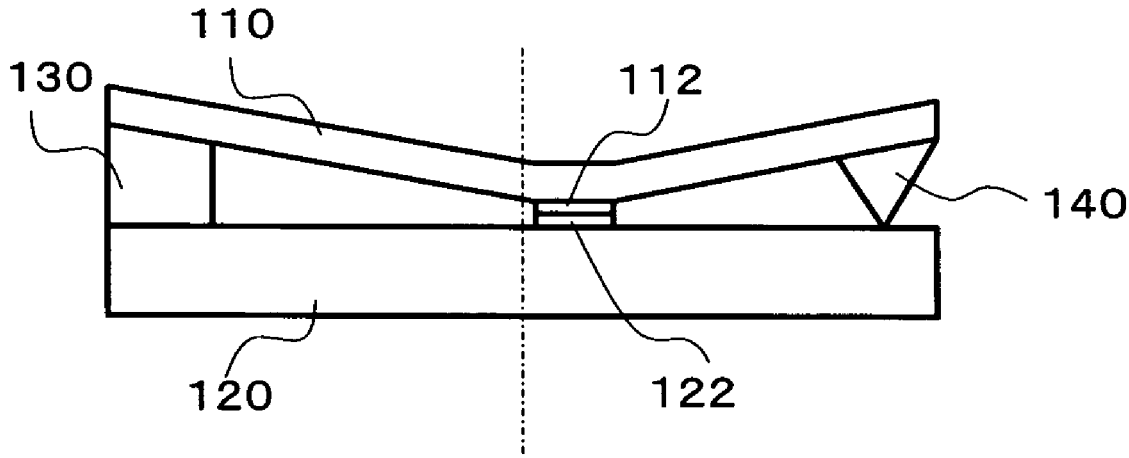
FIG. 8 is a side view of the first modification of the microrelay as a first switch device that is in an ON state.

There are the following modifications that can be made to the microrelay as the first switch device. For example, in a first modification of the microrelay as the first switch device illustrated in FIGS. 7 and 8, the protrusion 140 is provided at the free end of the movable spring 110.

Figure 9:
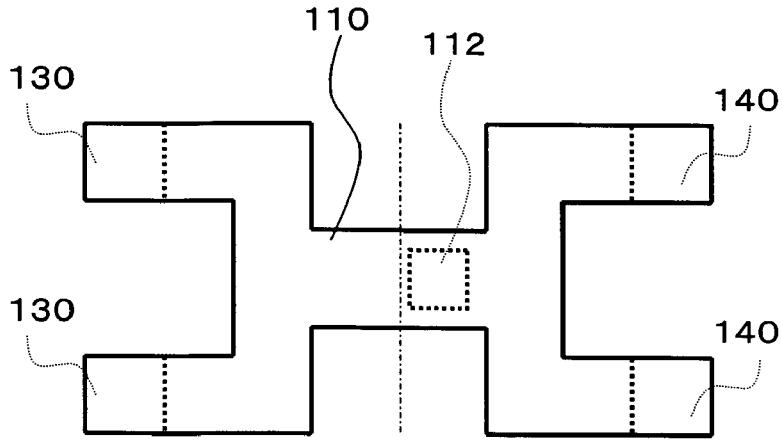
FIG. 9 is a top view of a second modification of the microrelay as a first switch device.
Figure 10:
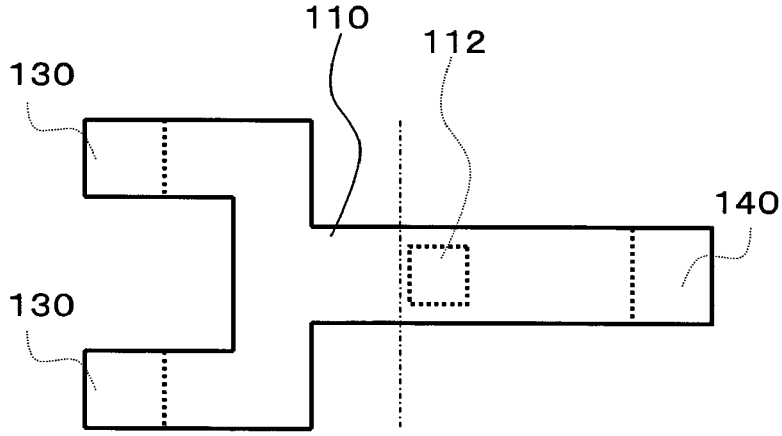
FIG. 10 is a top view of a third modification of the microrelay as a first switch device.
Figure 11:
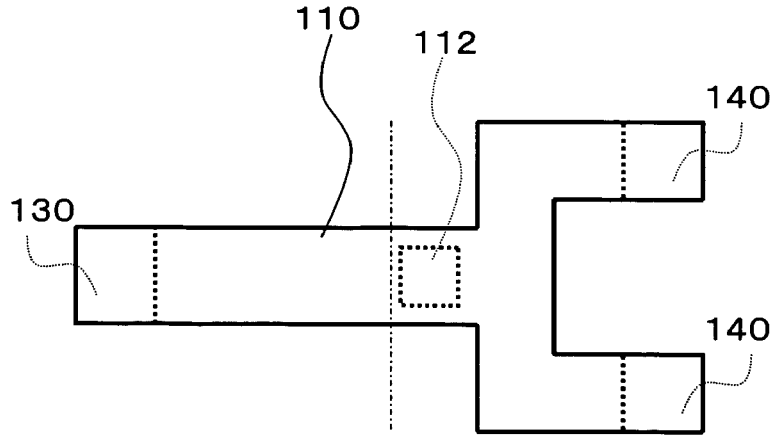
FIG. 11 is a top view of a fourth modification of the microrelay as a first switch device.

In a second modification of the microrelay as the first switch device illustrated in FIG. 9, there are more than one fixed end and more than one free end in the movable spring 110. In a third modification of the microrelay as the first switch device illustrated in FIG. 10, more than one fixed end is formed in the movable spring 110. In a fourth modification of the microrelay as the first switch device illustrated in FIG. 11, more than one free end is formed in the movable spring 110.

Figure 12A:
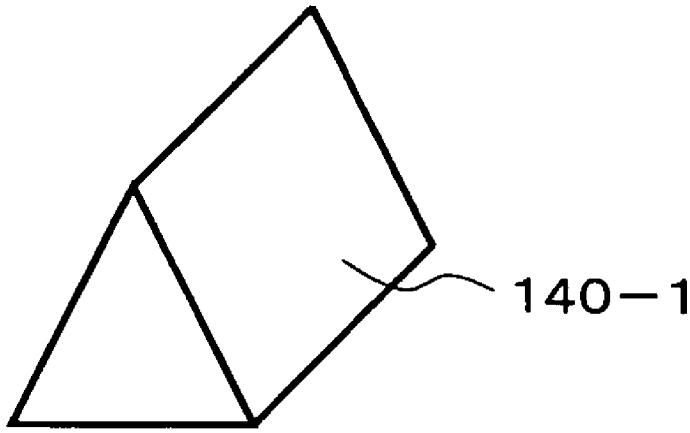
FIGS. 12A through 12C illustrate example shapes of the protrusion.
Figure 12B:
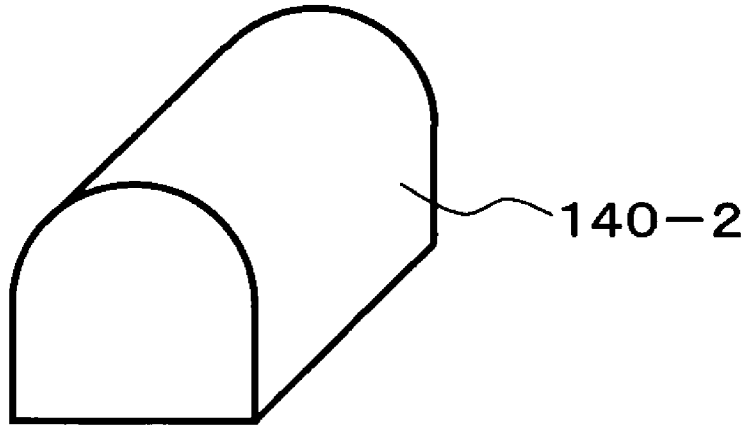
Figure 12C:
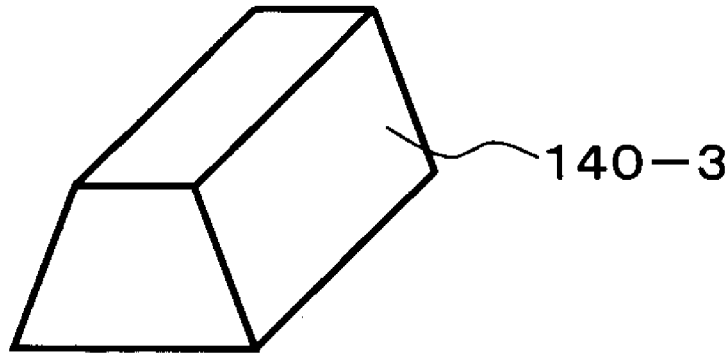

In a case where the protrusion 140 is formed on the substrate 120, the section area of the protrusion 140 is smaller as it is located closer to the movable spring 110. In a case where the protrusion 140 is provided on the movable spring 110, the section area of the protrusion 140 is smaller as it is located closer to the substrate 120. FIGS. 12A through 12C show possible examples of the protrusion 140. The protrusion 140 may also have a spherical shape.

Figure 13:
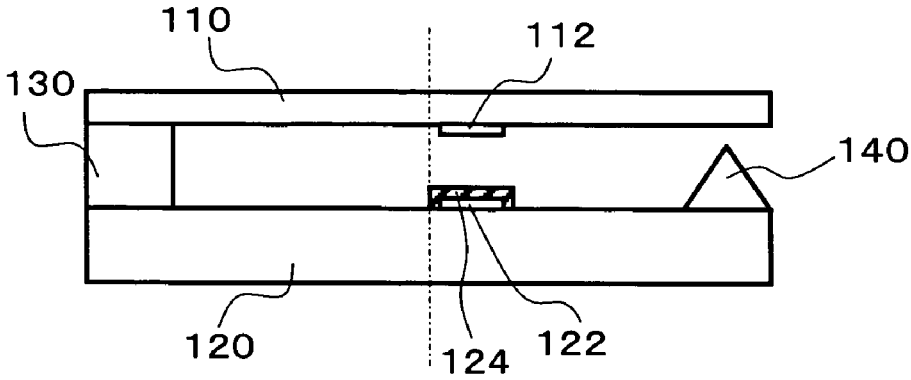
FIG. 13 is a side view of a capacitance-type switch as a second switch device that is in an OFF state.

Next, a second switch device is described. FIG. 13 is a side view of a capacitance-type switch that is a second switch device. The capacitance-type switch illustrated in FIG. 13 differs from the microrelay of FIG. 5 in that a dielectric layer 124 is provided on the surface of the contact point 122 that is the fixed contact point.

Figure 14:
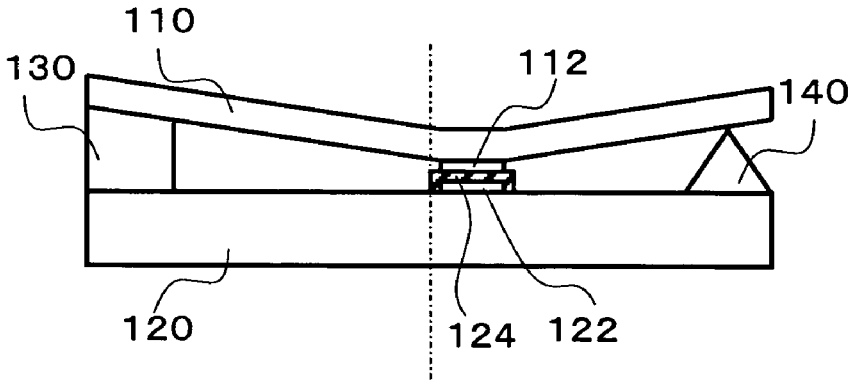
FIG. 14 is a side view of the capacitance-type switch as a second switch device that is in an ON state.

When a voltage is applied between the contact point 112 and the contact point 122 in the capacitance-type switch that is the second switch device, the movable spring 110 except the fixed end moves downward until the free end of the movable spring 110 comes into contact with the top portion of the protrusion 140 and the surface of the contact point 112 comes into contact with the surface of the contact point 122 via the dielectric layer 124, as shown in FIG. 14, by virtue of the electrostatic attraction between the contact point 112 and the contact point 122. Thus, the capacitance-type switch is put into an ON state. When the voltage between the contact point 112 and the contact point 122 is cut off, the contact point 112 moves away from the contact point 122 by virtue of the restoring force of the movable spring 110, and the capacitance-type switch is put into an OFF state.

As described above, in the capacitance-type switch that is the second switch device, the free end of the movable spring 110 is brought into contact with the protrusion 140 as the movable spring 110 bends down, as in the microrelay that is the first switch device. Accordingly, short-circuiting between the movable spring 110 and the substrate 120 except the contact point 112 and the contact point 122 is prevented, and the contact resistance can be stabilized as the surface of the contact point 112 of the movable spring 110 is brought into contact with the surface of the contact point 122 of the substrate 120. Also, the service lives of the contact point 112 and the contact point 122 can be prolonged. Furthermore, since one end of the movable spring 110 is a free end, the degree of freedom in movement of the movable spring 110 is higher than in a case where both ends of the movable spring are fixed ends, and there is no need to increase the voltage to bring the contact point 112 into contact with the contact point 122. Furthermore, as the surface of the contact point 112 is brought into contact with the surface of the contact point 122 in an ON state, the capacitance between the contact points becomes higher, and the change of the capacitance between the contact points can be made greater when the capacitance-type switch is switched between an ON state and an OFF state. Thus, control on the switching on and off of AC signals can be properly performed.

Figure 15:
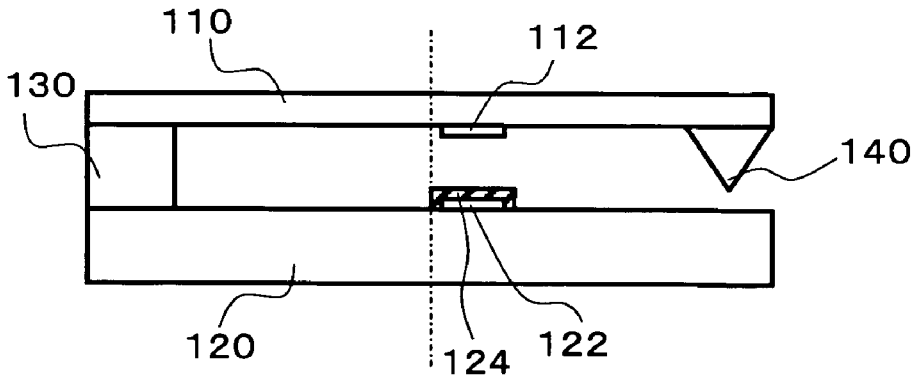
FIG. 15 is a side view of a first modification of the capacitance-type switch as a second switch device that is in an OFF state.
Figure 16:
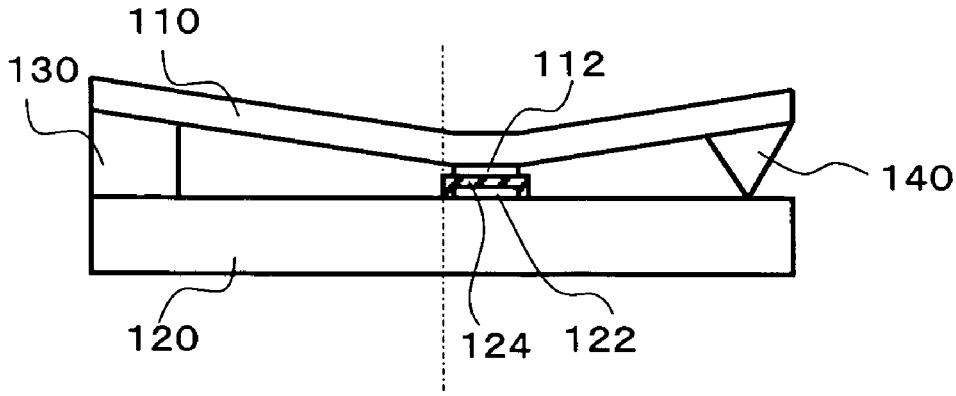
FIG. 16 is a side view of the first modification of the capacitance-type switch as a second switch device that is in an ON state.

There are the following modifications that can be made to the capacitance-type switch as the second switch device. For example, in a modification of the capacitance-type switch as the second switch device illustrated in FIGS. 15 and 16, the protrusion 140 is provided at the free end of the movable spring 110. There may be more than one fixed end and more than one free end in the movable spring 110. Alternatively, the movable spring 110 may have more than one fixed end or more than one free end.

Figure 17:
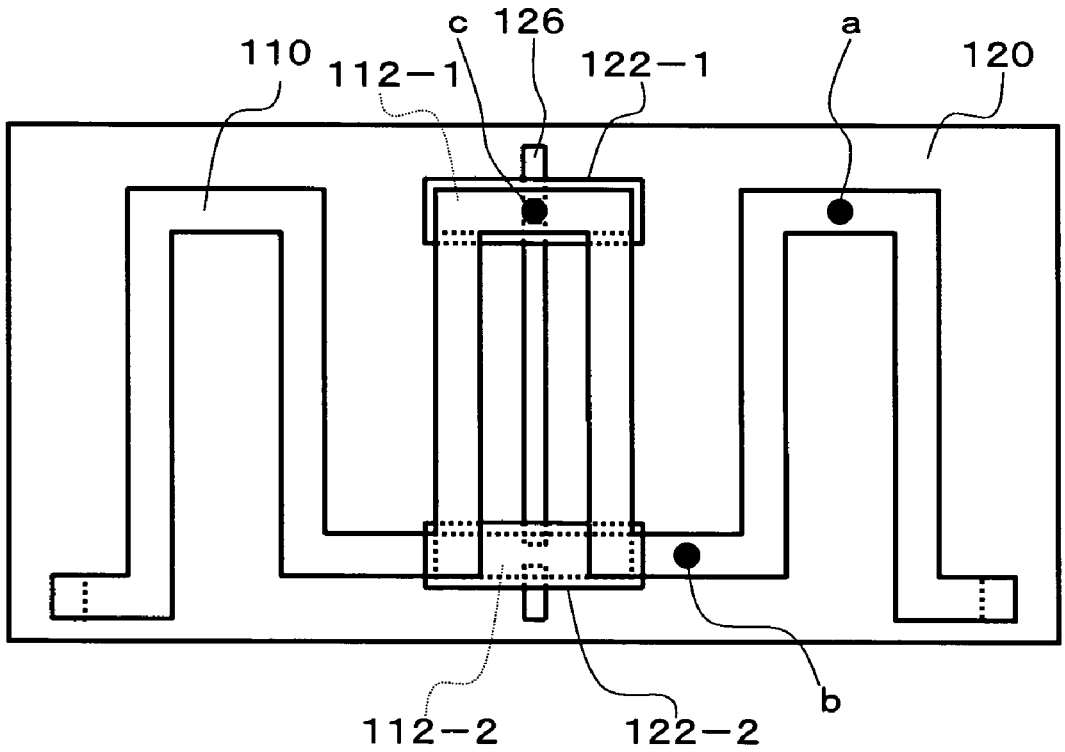
FIG. 17 is a top view of a microrelay as a third switch device.
Figure 18:
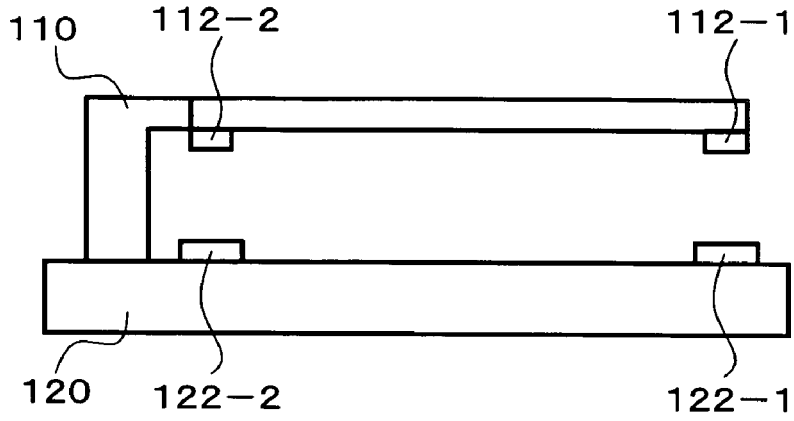
FIG. 18 is a side view of the microrelay as a third switch device that is in an OFF state.

Next, a third switch device is described. FIGS. 17 and 18 are a top view and a side view of a microrelay that is the third switch device of the present invention. In the microrelay illustrated in FIG. 17, a movable spring 110 in a serpentine shape having bent portions is provided above a substrate 120. This movable spring 110 has both ends fixed. A first contact point 112-1 that serves as a movable contact point is provided at the center portion (located at the same distance from both ends) of the movable spring 110. A third contact point 122-1 that serves as a fixed point is provided on a line 126 on the substrate 120. The third contact point 122-1 is located to vertically face the first contact point 112-1.

A second contact point 112-2 that serves as a movable contact point is provided to horizontally face the first contact point 112-1 of the movable spring 110. A fourth contact point 122-2 that serves as a fixed point on the line 126 is also provided on the substrate 120. The fourth contact point 122-2 is located to vertically face the second contact point 112-2. At least one of the first contact point 112-1 and the third contact point 122-2 is made of a metal with high hardness (for example, a platinum metal such as Rh or Ru, or W), while at least one of the second contact point 112-2 and the fourth contact point 122-2 is made of an Au metal that is relatively soft and exhibits low contact resistance. In the situation illustrated in FIG. 18, the first contact point 112-1 is not in contact with the third contact point 122-1, and the second contact point 112-2 is not in contact with the fourth contact point 122-2, either. Therefore, the microrelay is in an OFF state.

Figure 19:
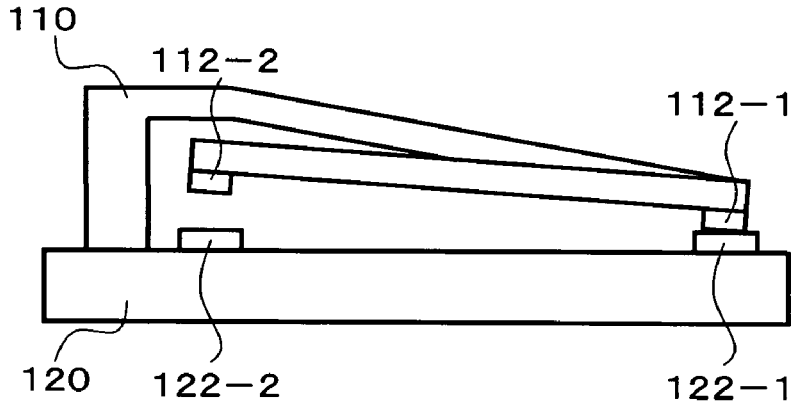
FIG. 19 is a side view of the microrelay as a third switch device during a switching operation.
Figure 20:
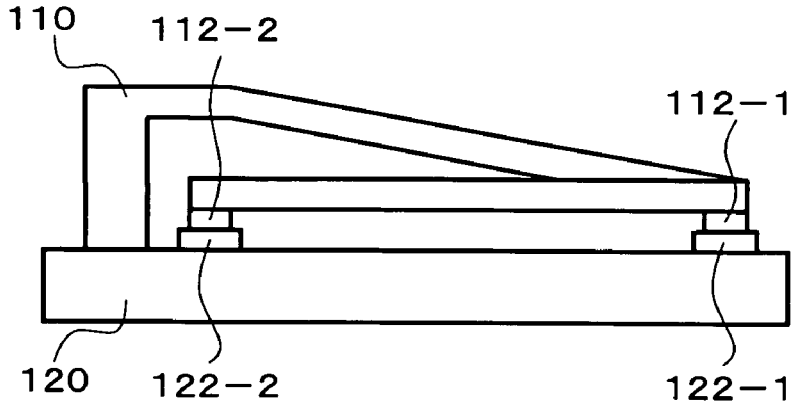
FIG. 20 is a side view of the microrelay as a third switch device that is in an ON state.

When a voltage is applied between the first contact point 112-1 and the third contact point 122-1, the movable spring 110 except the fixed end moves downward until the first contact point 112-1 comes into contact with the third contact point 122-1, as shown in FIG. 19, by virtue of the electrostatic attraction between the first contact point 112-1 and the third contact point 122-1. When a voltage is further applied between the second contact point 112-2 and the fourth contact point 122-2, the movable spring 110 moves downward by virtue of the electrostatic attraction between the second contact point 112-2 and the fourth contact point 122-2, with the contact portion between the first contact point 112-1 and the third contact point 122-1 being the point of support. As a result, the surface of the first contact point 112-1 comes into contact with the surface of the third contact point 122-1, and the surface of the second contact point 112-2 comes into contact with the surface of the fourth contact point 122-2, as shown in FIG. 20. Thus, the microrelay is put into an ON state. Among the points a, b, and c shown in FIG. 17, the point c has the largest displacement with respect to the fixed end, followed by the point b and the point a in this order. When the voltage between the second contact point 112-2 and the fourth contact point 122-2 is cut off, the second contact point 112-2 moves away from the fourth contact point 122-2 by virtue of the restoring force of the movable spring 110. When the voltage between the first contact point 112-1 and the third contact point 122-1 is cut off, the first contact point 112-1 moves away from the third contact point 122-1 by virtue of the restoring force of the movable spring 110. As a result, the microrelay is put into an OFF state.

As described above, in the microrelay that is the third switch device, the surfaces of the contact points (the first contact point 112-1 and the second contact point 112-2) of the movable spring 110 are brought into contact with the surfaces of the contact points (the third contact point 122-1 and the fourth contact point 122-2) of the substrate 120. Accordingly, the reliability in switching operations can be increased. As the first contact point 112-1 is brought into contact with the third contact point 122-1, the movable spring 110 can move, with the contact portion between the first contact point 112-1 and the third contact point 122-1 being the point of support. With this structure, the second contact point 112-2 can be readily brought into contact with the fourth contact point 122-2. Furthermore, since at least one of the first contact point 112-1 and the third contact point 122-1, which are first brought into contact with each other, is made of a metal with high hardness, at least one of the first contact point 112-1 and the third contact point 122-1 can be prevented from abrading away due to electric discharge.

Figure 21:
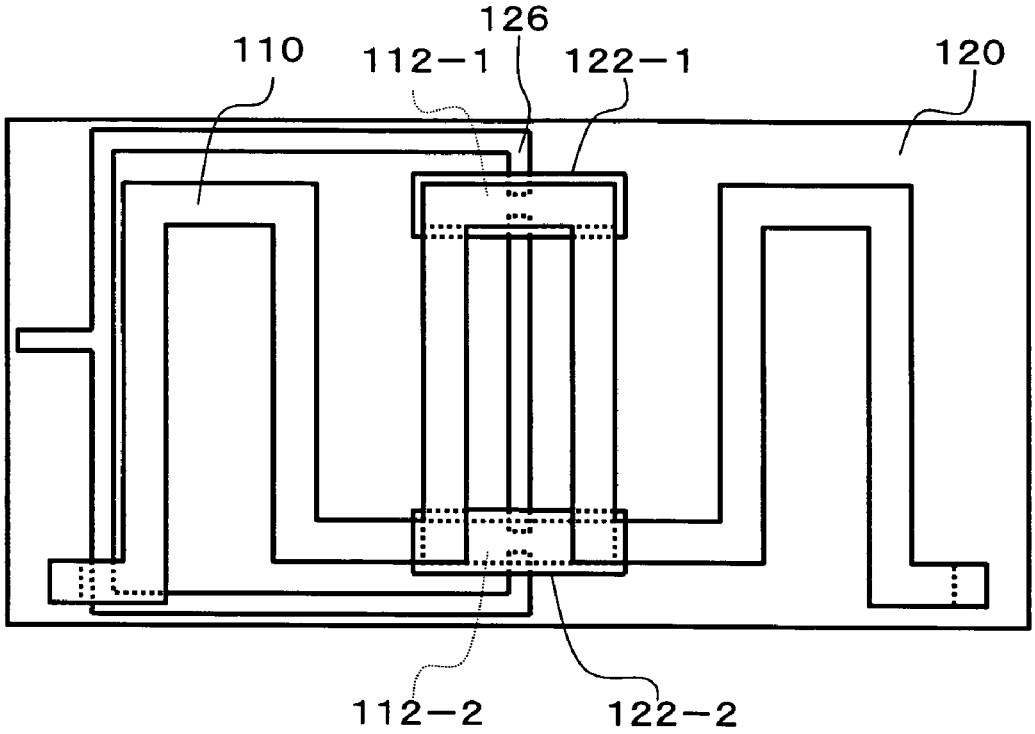
FIG. 21 is a top view of a first modification of the microrelay as a third switch device.
Figure 22:
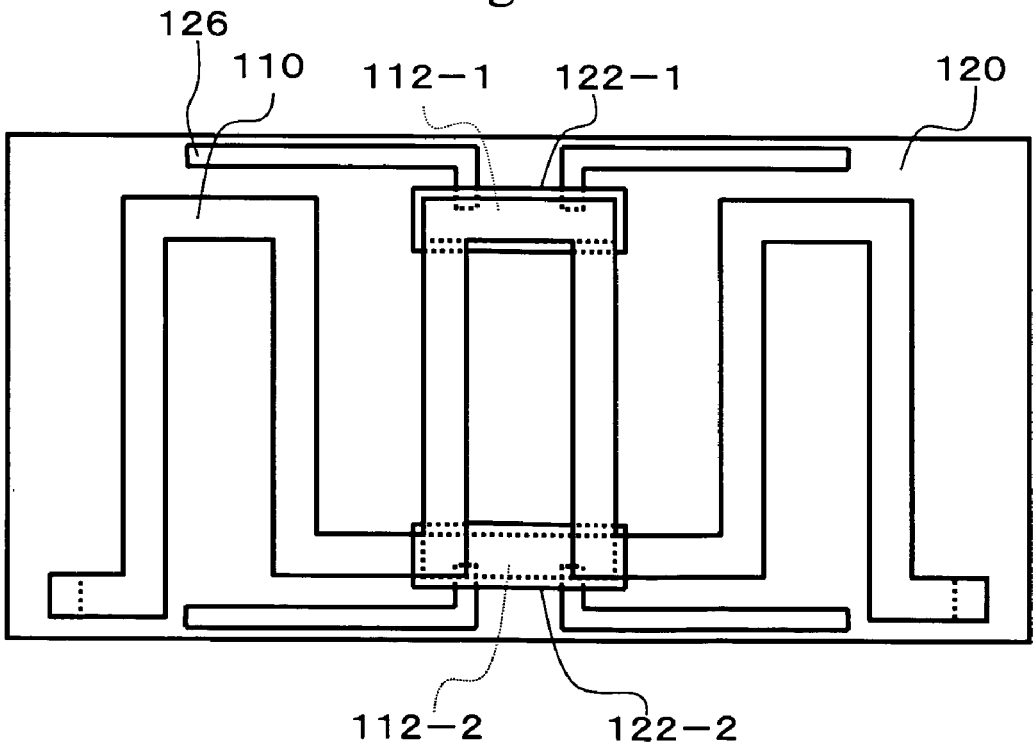
FIG. 22 is a top view of a second modification of the microrelay as a third switch device.

There are the following modifications that can be made to the microrelay as the third switch device. For example, in a first modification of the microrelay as the third switch device illustrated in FIG. 21, the third contact point 122-1 and the fourth contact point 122-2 are connected in series. In such a case, at least one of the second contact point 112-2 and the fourth contact point 122-2, which are brought into contact with each other later, should be made of a metal with high hardness. In a second modification of the microrelay as the third switch device illustrated in FIG. 22, the third contact point 122-1 and the fourth contact point 122-2 are connected in parallel. In such a case, at least one of the first contact point 112-1 and the third contact point 122-1, which are brought into contact with each other first, should be made of a metal with high hardness.

Figure 23:
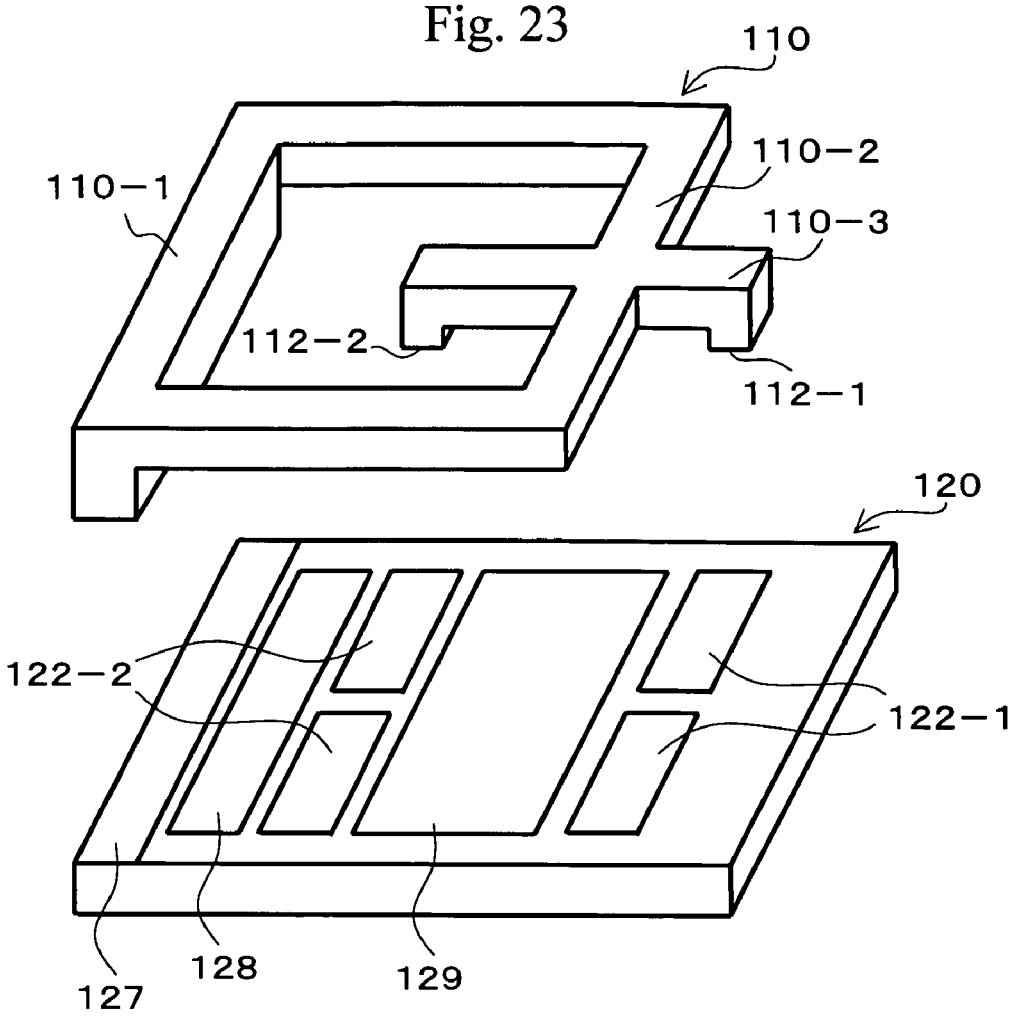
FIG. 23 is a perspective view of a second modification of the microrelay as a third switch device.

In a third modification of the microrelay as the third switch device illustrated in FIG. 23, one end of a rectangularly annular movable spring 110 is a fixed end 110-1, and a protrusion 110-3 is provided at the end 110-2 opposite to the fixed end 110-1. The first contact point 112-1 is provided at the end of the shorter portion of the protrusion 110-3, and the second contact point 112-2 is provided at the end of the longer portion of the protrusion 110-3. The substrate 120 has a placement portion 127 for the fixed end 110-1 of the movable spring 110. On the substrate 120, the third contact point 122-1 is disposed to vertically face the first contact point 112-1, and the fourth contact point 122-2 is disposed to vertically face the second contact point 112-2. Further, electrodes 128 and 129 are provided on the substrate 120.

In the third modification of the microrelay as the third switch device, when a voltage is applied between the first contact point 112-1 and the third contact point 122-1, the movable spring 110 except the fixed end 110-1 moves downward by virtue of the electrostatic attraction between the first contact point 112-1 and the third contact point 122-1, so that the first contact point 112-1 comes into contact with the third contact point 122-1. When a voltage is further applied between the second contact point 112-2 and the fourth contact point 122-2, the movable spring 110 moves downward by virtue of the electrostatic attraction between the second contact point 112-2 and the fourth contact point 122-2, with the contact portion between the first contact point 112-1 and the third contact point 122-1 being the point of support. As a result, the surface of the first contact point 112-1 comes into contact with the surface of the third contact point 122-1, and the surface of the second contact point 112-2 comes into contact with the surface of the fourth contact point 122-2. Thus, the microrelay is put into an ON state.

Figure 24:
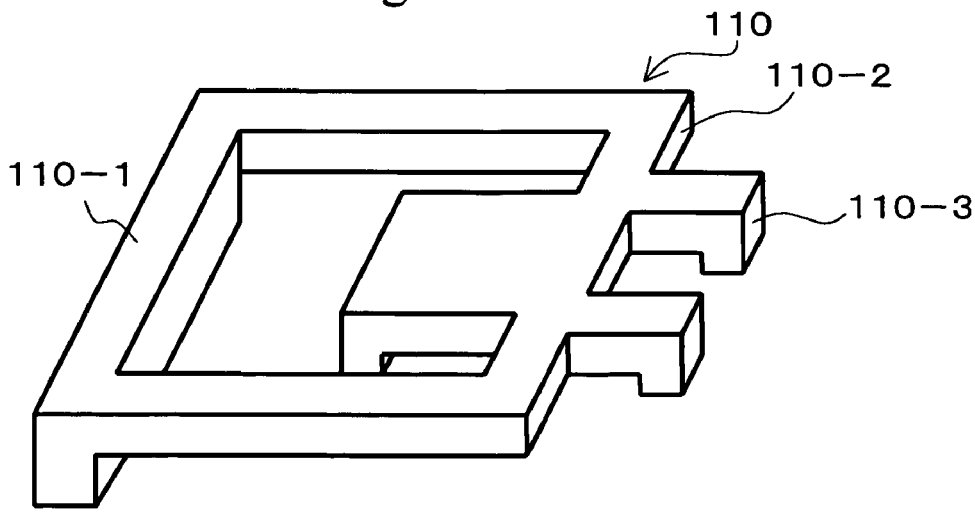
FIG. 24 is a perspective view of a first modification of the movable spring of the microrelay as a third switch device.
Figure 25:
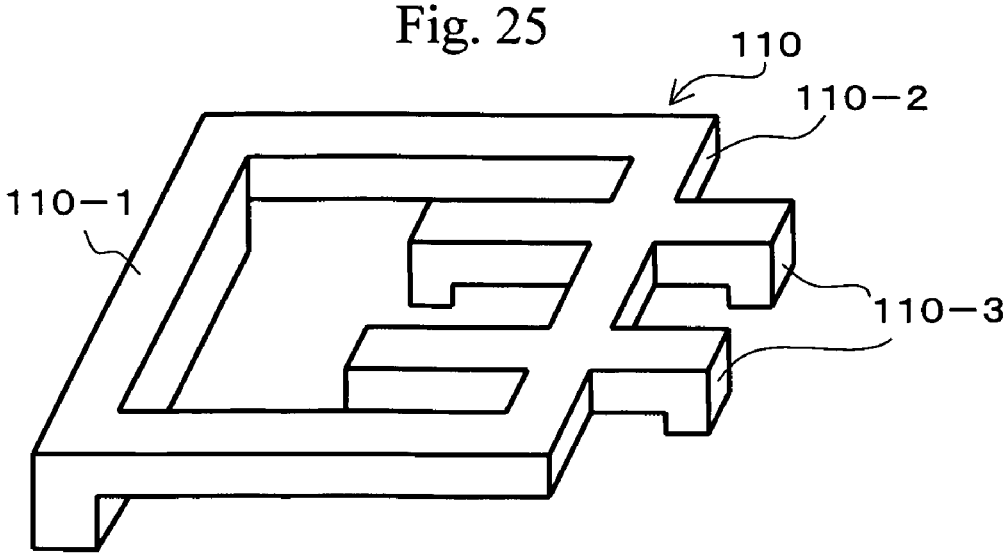
FIG. 25 is a perspective view of a second modification of the movable spring of the microrelay as a third switch device.

Instead of the movable spring 110 shown in FIG. 23, a movable spring 110 having a protrusion 110-3 with two shorter portions shown in FIG. 24 or a movable spring 110 having a protrusion 110-3 with two shorter portions and two longer portions shown in FIG. 25 may be employed.

Figure 26:
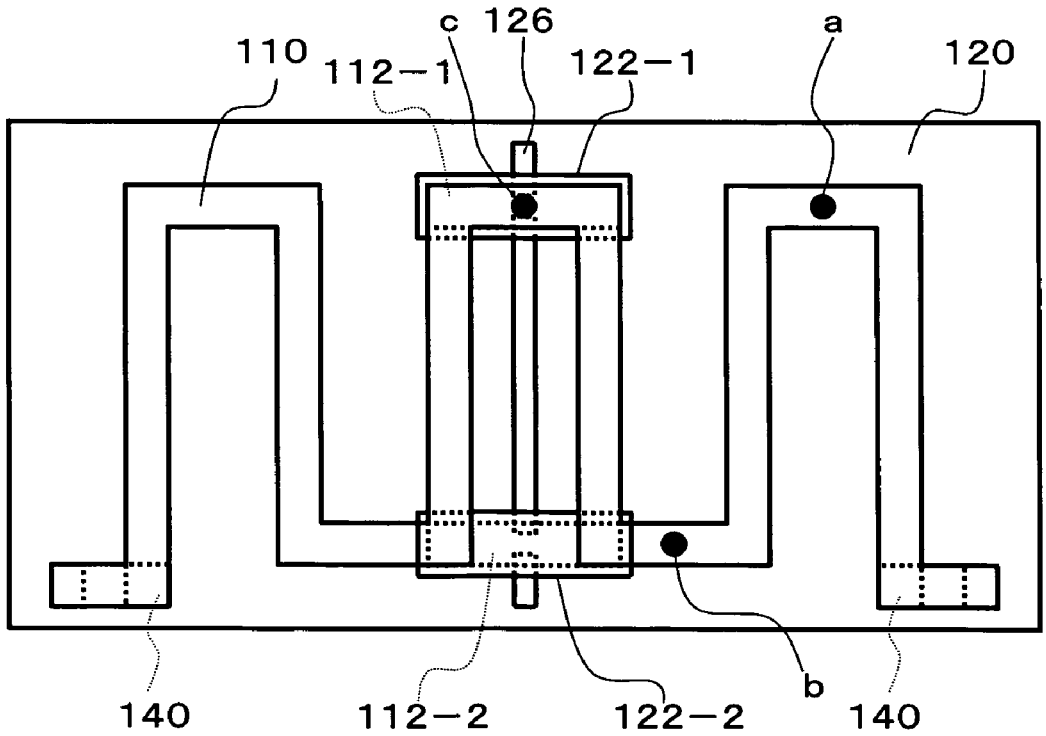
FIG. 26 is a top view of a third modification of the microrelay as a third switch device.

It is also possible to employ a movable spring 110 having protrusions 140 in the vicinity of the fixed end on either the movable spring 110 or the substrate 120, as shown in FIG. 26. In such a case, among the points a, b, and c in FIG. 26, the point c has the largest displacement, followed by the point a and the point b in this order.

Figure 27:
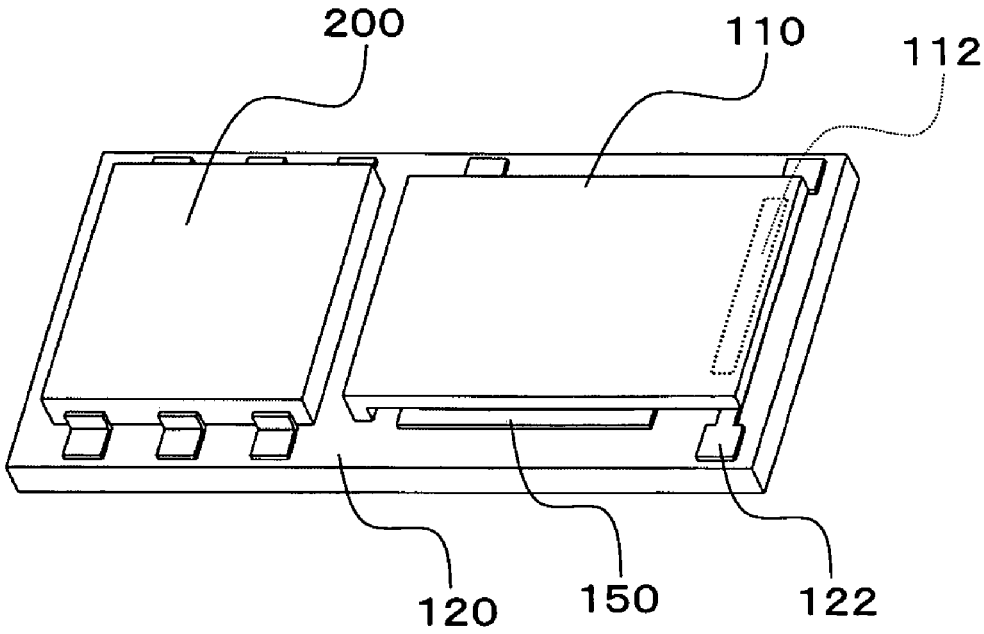
FIG. 27 is a perspective view of a first integrated circuit that employs a microrelay as a fourth switch device.
Figure 28:
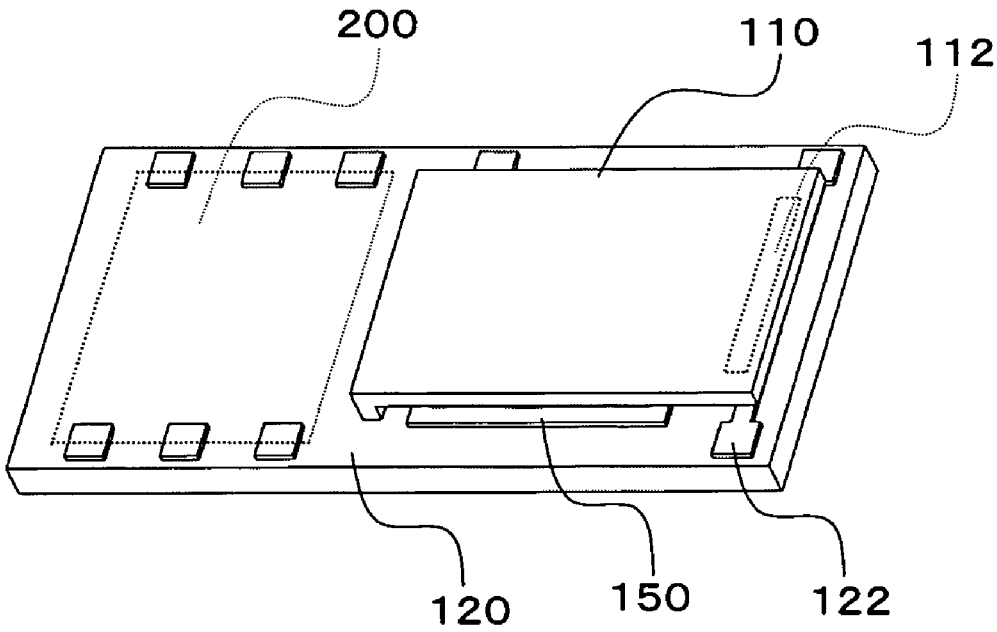
FIG. 28 is a perspective view of a second integrated circuit that employs a microrelay as a fourth switch device.

Next, a fourth switch device is described. FIGS. 27 and 28 are perspective views of integrated circuits that employ microrelays that are fourth switch devices. The integrated circuit illustrated in FIG. 27 is formed with a microrelay and an IC chip 200. The microrelay includes a movable spring 110, a contact point 112, a substrate 120, a contact point 122, and a flat coil 150. The IC chip 200 is disposed on the substrate 120 and includes an external control switch unit that will be described later in detail. The integrated circuit illustrated in FIG. 28 is formed with a microrelay and an IC chip 200. The microrelay includes a movable spring 110, a contact point 112, a substrate 120, a contact point 122, and a flat coil 150. The IC chip 200 is placed inside the substrate 120 and includes an external control switch unit.

Figure 29:
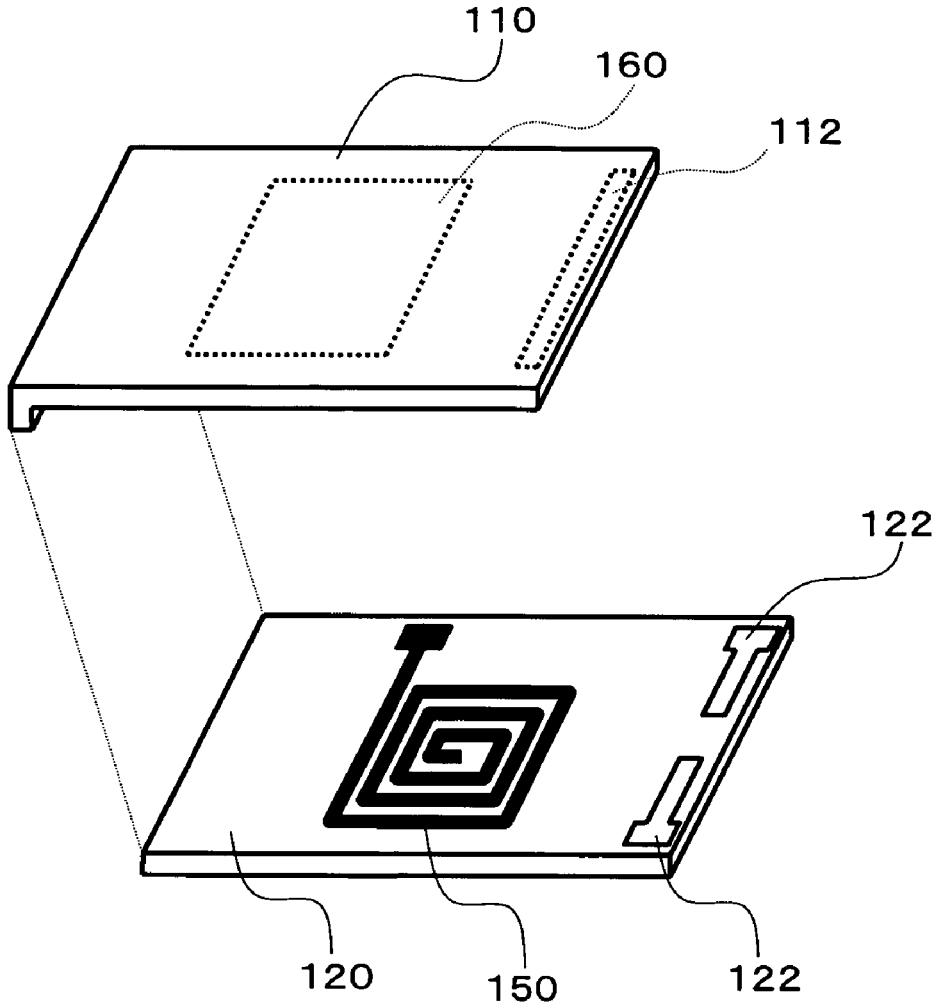
FIG. 29 is an exploded perspective view of a microrelay as a fourth switch device.
Figure 30:
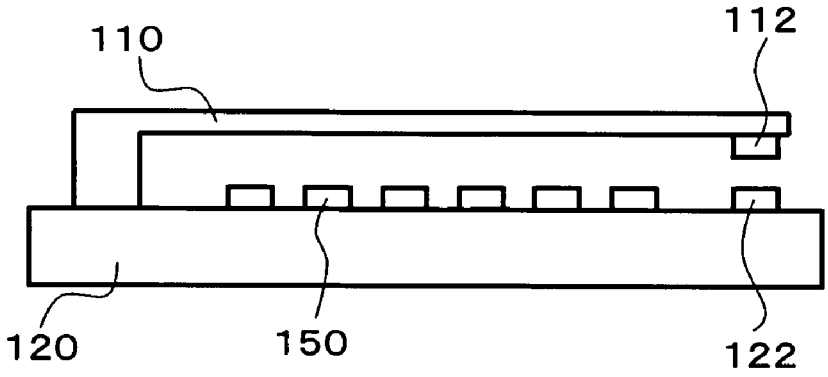
FIG. 30 is a cross-sectional view of a microrelay as a fourth switch device that is in an OFF state.

FIG. 29 is an exploded perspective view of a microrelay that is a fourth switch device. FIG. 30 is a cross-sectional view of a microrelay that is also a fourth switch device. In each of the microrelays illustrated in FIGS. 29 and 30, a movable spring 110 is placed above a substrate 120. This movable spring 110 has one end as a fixed end and the other end as a free end. A contact point 112 that serves as a movable contact point is provided at the free end of the movable spring 110, and a contact point 122 that serves as a fixed contact point is provided on the substrate 120. The contact point 122 is located to vertically face the contact point 112. A flat coil 150 is further provided on the substrate 120. The flat coil 150 is located to vertically face a magnetic member 160. An end of the flat coil 150 is connected to a line (not shown) provided on the bottom surface of the substrate 120 via a through hole (not shown). In the situation illustrated in FIG. 5, the contact point 112 is not in contact with the contact point 122, and therefore, the microrelay is in an OFF state.

Figure 31A:
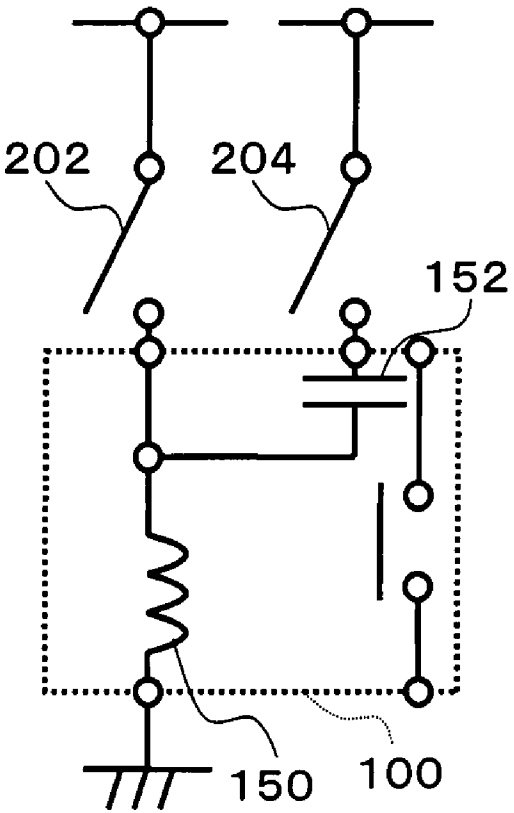
FIGS. 31A through 31C illustrate the operation of the external control switch.
Figure 31B:
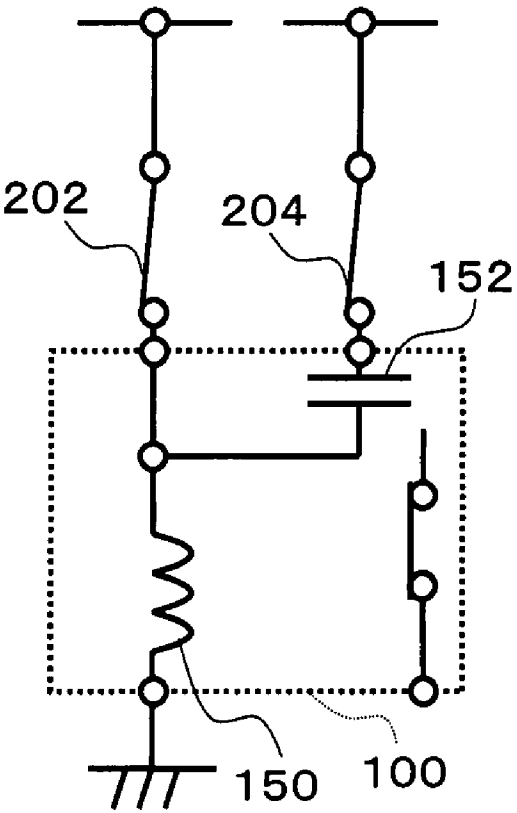
Figure 31C:
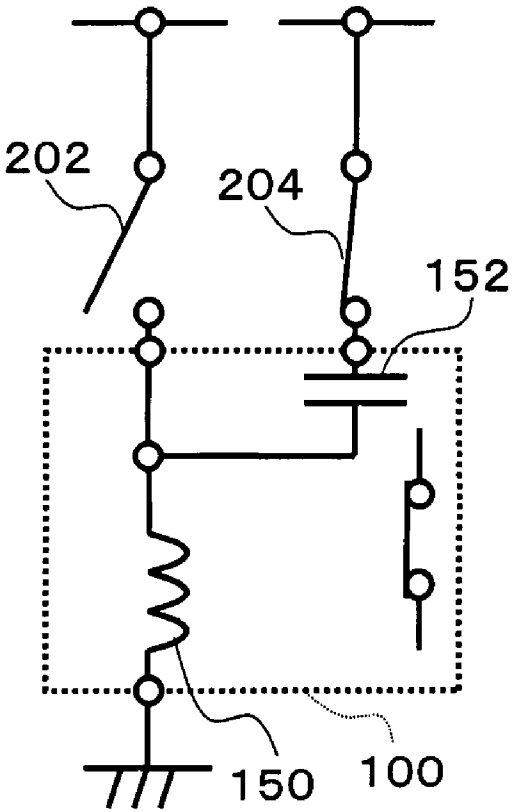
Figure 32:
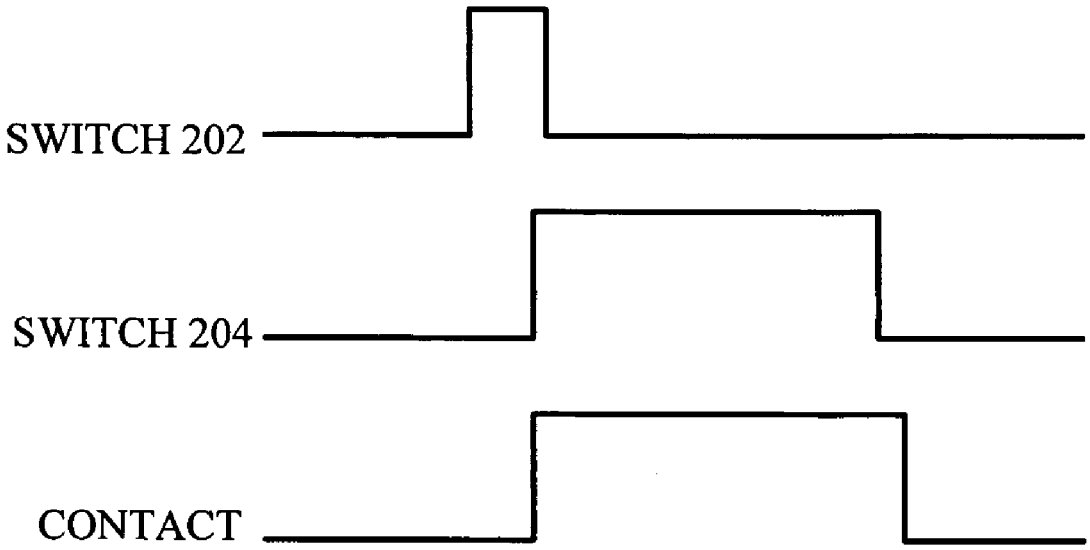
FIG. 32 is a timing chart showing the states of the switch and the contact points.

The contact between the contact point 112 and the contact point 122 is controlled by the external control switch unit in the IC chip 200. FIGS. 31A through 31C illustrate the operation of the external control switch unit. FIG. 32 is a timing chart showing the states of the switch and the contact points.

Figure 33:
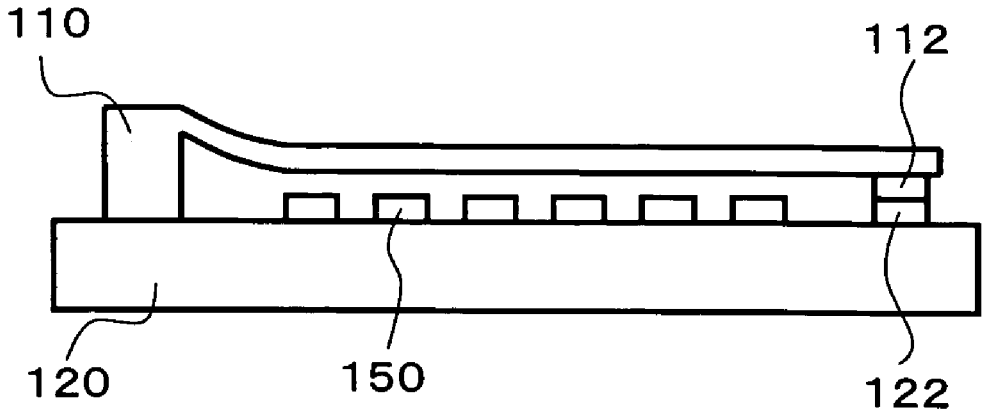
FIG. 33 is a cross-sectional view of a microrelay as a fourth switch device that is in an ON state.

When switches 202 and 204 are in an OFF state as shown in FIG. 31A, the flat coil 150 and a capacitor 152 in the microrelay 100 are not energized, and the microrelay 100 is in an OFF state. As the switch 202 is put into an ON state as shown in FIG. 31B, the flat coil 150 is energized, and the movable spring 110 other than the fixed end moves downward by virtue of the electromagnetic attraction produced by the electromagnetic induction of the flat coil 150. Accordingly, the contact point 112 approaches the contact point 122. As the switch 204 is put into an ON state, the capacitor 152 in the microrelay 100 is energized, and the surface of the contact point 112 is brought into contact with the surface of the contact point 122 by virtue of the electrostatic attraction between the contact point 112 and the contact point 122, as shown in FIG. 33. Thus, the microrelay 100 is put into an ON state. The switch 202 is then put into an OFF state, as shown in FIG. 31C, and the contact between the surface of the contact point 112 and the surface of the contact point 122 is maintained only by virtue of the electrostatic attraction between the contact point 112 and the contact point 122. The contact between the contact point 112 and the contact point 122 is maintained until the switch 204 is put into an OFF state. When the switch 204 is put into an OFF state, the contact point 112 moves away from the contact point 122 by virtue of the restoring force of the movable spring 110.

Figure 34:
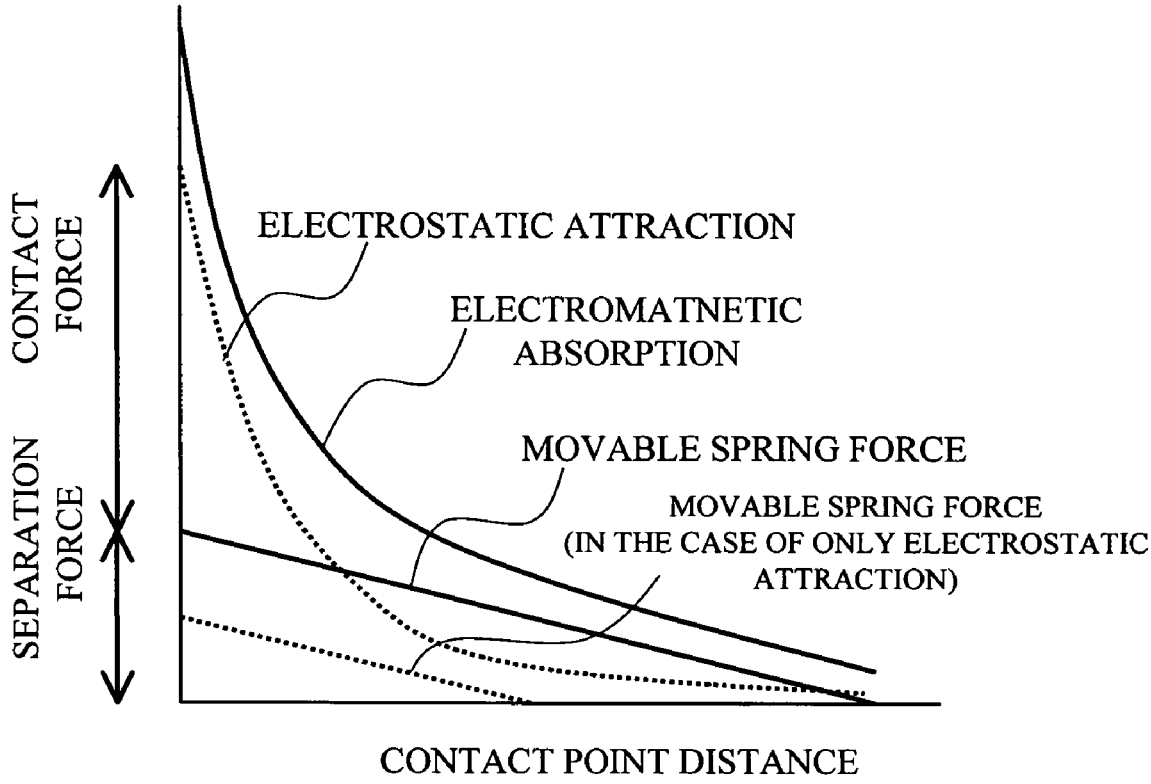
FIG. 34 shows the relationship among the distance between the contact points, the load of the movable spring, and the attraction of the movable spring.

FIG. 34 shows the relationship among the distance between the contact points, the load of the movable spring 110, and the attraction of the movable spring 110. As shown in FIG. 34, only with electrostatic attraction, the driving force of the movable spring 110 is inversely proportional to the square of the distance between the contact points. Therefore, if the driving voltage cannot be increased, the distance between the contact points should be shortened, or the load (the spring force) of the movable spring 110 needs to be reduced. However, if the distance between the contact points or the load is reduced, the contact point 112 may be unnecessarily brought into contact with the contact point 122.

If there is electromagnetic attraction, the driving force of the movable spring 110 can be increased with a low voltage. Accordingly, the load of the movable spring 110 and the distance between the contact points are increased, so that the movable spring 110 moves downward by virtue of the electromagnetic attraction until the distance between the contact points becomes such a length as to sufficiently increase the electrostatic attraction. After that, the contact between the contact point 112 and the contact point 122 is maintained only by virtue of the electrostatic attraction, so as to prevent a power consumption increase caused by maintaining the electromagnetic attraction.

As described above, in the microrelay that is a fourth switch device, the movable spring 110 is attracted toward the substrate 120 by virtue of the electromagnetic attraction produced by voltage application to the flat coil 150, and the contact between the contact point 112 and the contact point 122 can be maintained by virtue of the electrostatic attraction produced by voltage application between the contact point 112 and the contact point 122. Even if the voltage to be applied between the contact point 112 and the contact point 122 is reduced, the contact point 112 can be certainly brought into contact with the contact point 122.

Figure 35:
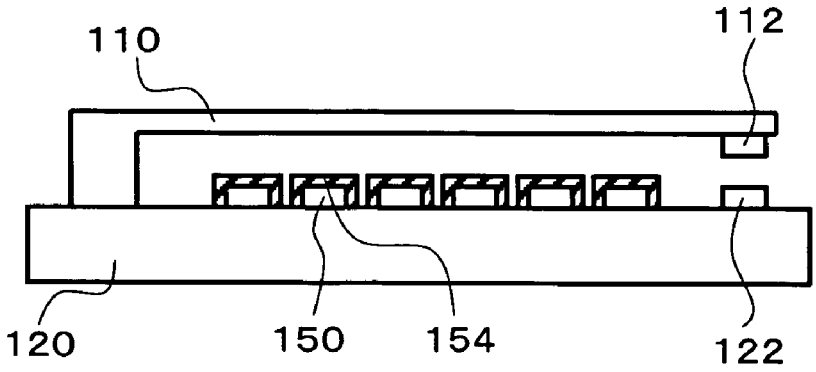
FIG. 35 is a cross-sectional view of a first modification of a microrelay as a fourth switch device that is in an OFF state.

There are the following possible modifications of the microrelay as a fourth switch device. For example, in a first modification of the microrelay as a fourth switch device illustrated in FIG. 35, an insulating layer 154 is formed on the surface of the flat coil 150. With this arrangement, short-circuiting due to contact between the flat coil 150 and the contact point 112 is prevented, and the electrostatic attraction can be increased.

Figure 36:
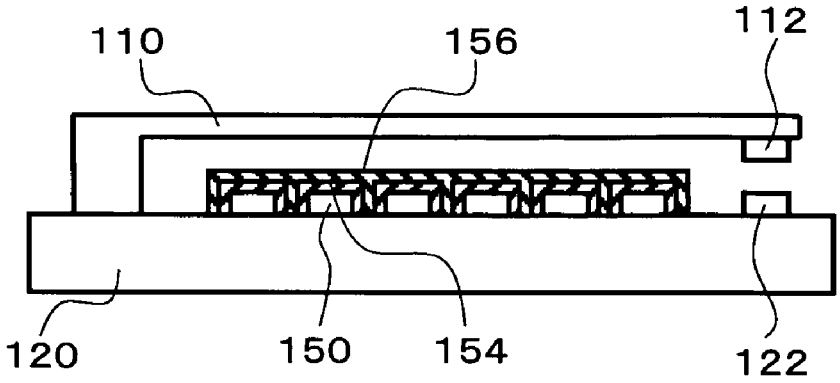
FIG. 36 is a cross-sectional view of a second modification of a microrelay as a fourth switch device that is in an OFF state.

In a second modification of the microrelay as a fourth switch device illustrated in FIG. 36, a magnetic member 156 is formed on the surface of the insulating layer 154. With this arrangement, the magnetic flux density of the flat coil 150 can be increased, and the magnetic member 156 serves as an electrode. Accordingly, the electrode area becomes larger than in the case where only the flat coil 150 is provided on the substrate 120, and the electrostatic attraction is increased. Also, another insulating layer may be formed on the surface of the magnetic member 156.

Figure 37:
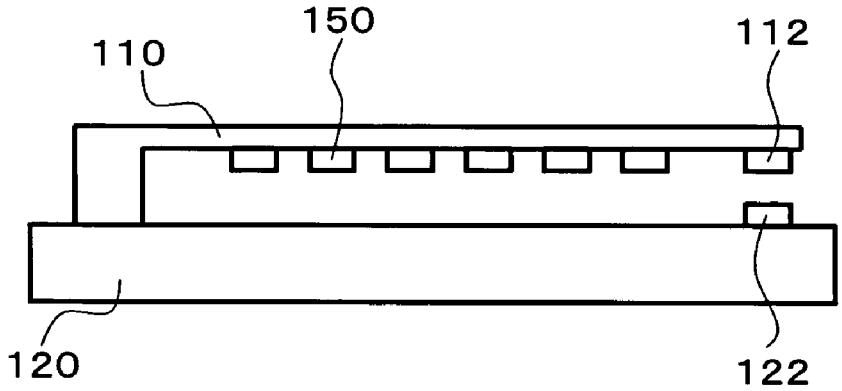
FIG. 37 is a cross-sectional view of a third modification of a microrelay as a fourth switch device that is in an OFF state.
Figure 38:
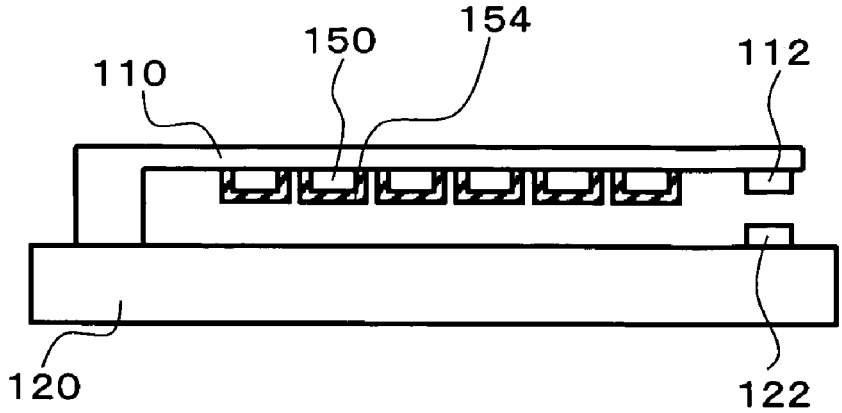
FIG. 38 is a cross-sectional view of a fourth modification of a microrelay as a fourth switch device that is in an OFF state.
Figure 39:
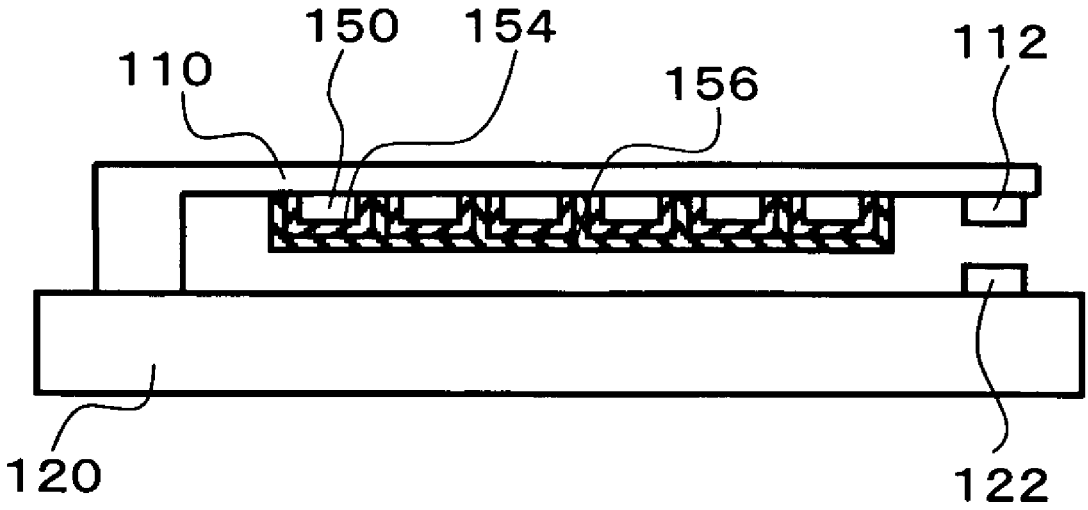
FIG. 39 is a cross-sectional view of a fifth modification of a microrelay as a fourth switch device that is in an OFF state.

In a third modification of the microrelay as a fourth switch device illustrated in FIG. 37, the flat coil 150 is attached to the movable spring 110. In a fourth modification of the microrelay as a fourth switch device illustrated in FIG. 38, the flat coil 150 is attached to the movable spring 110, and the insulating layer 154 covers the surface of the flat coil 150. In a fifth modification of the microrelay as a fourth switch device illustrated in FIG. 39, the magnetic member 156 covers the surface of the insulating layer 154.

As described so far, a switch device in accordance with the present invention exhibits a higher degree of freedom in movement of the movable spring. Thus, a more precise switching operation can be performed, and the switch device proves to be useful.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A switch device comprising:

a movable spring in a serpentine form, having bent portions and having an end as a fixed end;

a substrate that is disposed below the movable spring;

a first electrical contact point that is provided to the movable spring except the region of the fixed end;

a second electrical contact point that is provided to the movable spring except the region of the fixed end, the first electrical contact point being located at a position farthest from the fixed end;

a third electrical contact point that is provided onto the substrate and is located to face the first electrical contact point; and a fourth electrical contact point that is provided onto the substrate and is located to face the second electrical contact point, the switch device being put into an ON state when the first electrical contact point is brought into contact with the third contact point and the second electrical contact point is brought into contact with the fourth electrical contact point, the switch device being put into an OFF state when the first electrical contact point is separated from the third electrical contact point and the second electrical contact point is separated from the fourth electrical contact point.

2. The switch device as claimed in claim 1, wherein the switch device comprises a plurality of first electrical contact points and a plurality of third contact points.

3. The switch device as claimed in claim 1, wherein the switch device comprises a plurality of second electrical contact points and a plurality of fourth electrical contact points.

4. The switch device as claimed in claim 1, wherein the first electrical contact point is connected in series to the second electrical contact point.

5. The switch device as claimed in claim 1, wherein the first electrical contact point is connected in parallel to the second electrical contact point.

6. The switch device as claimed in claim 5, wherein at least one of the first electrical contact point and the third electrical contact point is made of a material with higher hardness than the material of the second electrical contact point and the fourth electrical contact point.

7. The switch device as claimed in claim 4, wherein at least one of the second electrical contact point and the fourth electrical contact point is made of a material with higher hardness than the material of the first electrical contact point and the third electrical contact point.

8. The switch device as claimed in claim 1, further comprising a protrusion that is provided on the substrate and is located to face a predetermined point between the fixed end of the movable spring and the first electrical contact point.

* * * * *